US006678907B1

(12) United States Patent
Voelker et al.

(10) Patent No.: US 6,678,907 B1
(45) Date of Patent: Jan. 20, 2004

(54) BED, ESPECIALLY A SICK-BED AND/OR NURSING BED, AND LENGTH-ADJUSTABLE SUPPORT ELEMENT FOR SAID BED

(75) Inventors: Heinrich Voelker, Witten (DE); Karlheinz Baumeister, Balingen/Ostdorf (DE)

(73) Assignee: Voelker Moebelproduktionsgesellschaft mbH, Witten (DE)

( * ) Notice: Subject to any disclaimer, the term of this patent is extended or adjusted under 35 U.S.C. 154(b) by 0 days.

(21) Appl. No.: 09/937,147

(22) PCT Filed: Mar. 22, 2000

(86) PCT No.: PCT/EP00/02529

§ 371 (c)(1),
(2), (4) Date: Nov. 30, 2001

(87) PCT Pub. No.: WO00/56259

PCT Pub. Date: Sep. 28, 2000

(30) Foreign Application Priority Data

Mar. 22, 1999 (DE) ..... 199 12 908

(51) Int. Cl.[7] ..... A61G 7/012
(52) U.S. Cl. ..... 5/611; 5/11
(58) Field of Search ..... 5/600, 610, 611, 5/11

(56) References Cited

U.S. PATENT DOCUMENTS 2,522,759 A * 9/1950 Lindquist ..... 5/610

(List continued on next page.)

FOREIGN PATENT DOCUMENTS

DE U8907197 1/1990
DE A19608171 9/1997

(List continued on next page.)

*Primary Examiner*—Robert G. Santos
(74) *Attorney, Agent, or Firm*—Birch, Stewart, Kolasch & Birch, LLP

(57) ABSTRACT

The bed (10) is provided with a height-adjustable lower frame (14) comprising a plurality of supporting legs (16) and with an upper frame (12) connected with said lower frame. Each supporting leg (16) comprises at its lower end (38) a swivelling and/or guide roller (40) which is received by the supporting leg (16) and is enclosed by a supporting edge (52) of the supporting leg (16) at the lower end (38) of the latter. Said roller (40) is retained by a retaining element (42,44) which is displaceably guided along the supporting leg (16) for the purpose of moving the roller (40) out of the lower end (38) of the supporting leg (16) beyond the supporting edge (52) of the latter and into the lower end (38) of the supporting leg (16). A lifting means (56) is movable out of the upper end (68) of the supporting leg (16) and into the upper end (68) of the supporting leg (16), said lifting means (56) comprising a fastening element (76) which is connected with the upper frame (12). For this bed (10) it is provided that the lifting means (56) comprises a double-spindle arrangment (58) having a drivable inner spindle (60) whose upper end (74) protrudes beyond the supporting leg (16), and a hollow spindle (62) receiving said inner spindle (60), wherein the upper end (74) of the inner spindle (60) can be brought in engagement with a driving element (84) adapted to be driven by a driving device (88) connectable with the fastening element (76), the inner spindle (60) threadedly engages with the hollow spindle (62) and the hollow spindle (62) threadedly engages with the supporting leg (16), the hollow spindle (62) and/or the inner spindle (60) presses/press against the retaining element (42,44) of the roller (40) near the end of its retraction movement into the supporting leg (16) and, upon further retraction movement, moves/move the supporting leg (16) towards the fastening element (76) such that the roller (40) of the supporting leg (16) protrudes downwards beyond the supporting edge (52), and the supporting leg (16) rests on its supporting edge (52) when the hollow spindle (62) is removed from the retaining element (42,44) of the roller (40).

17 Claims, 6 Drawing Sheets

U.S. PATENT DOCUMENTS

Figure 1:
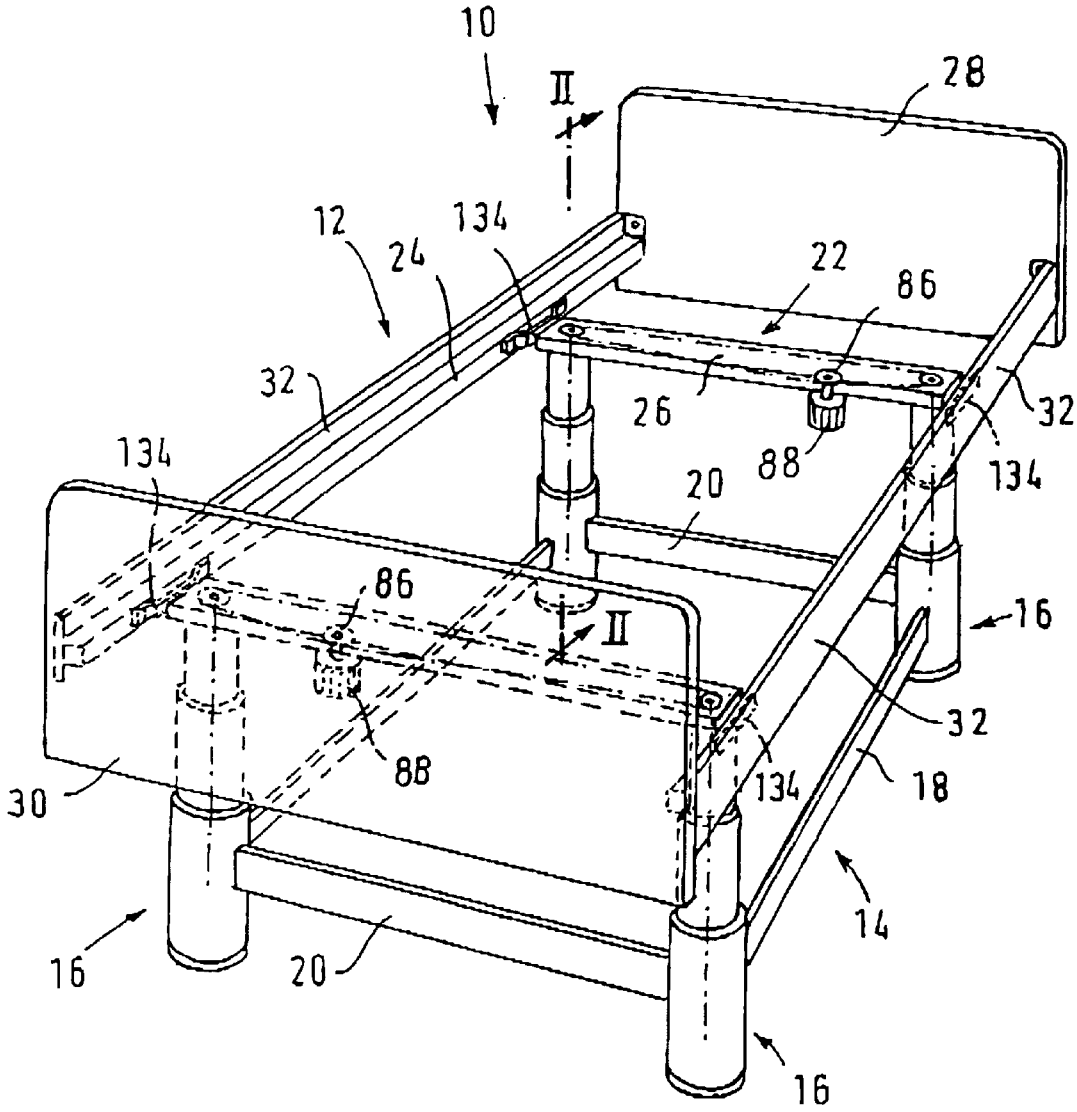

| | | | | | |
|---|---|---|---|---|---|
| 2,870,460 | A | * | 1/1959 | Sanford | 5/11 |
| 3,465,373 | A | * | 9/1969 | Wilson | 5/611 |
| 3,742,527 | A | * | 7/1973 | Johnston et al. | 5/611 |
| 5,095,560 | A | * | 3/1992 | Volker | 5/11 |
| 5,172,442 | A | * | 12/1992 | Bartley et al. | 5/611 |
| 5,903,940 | A | * | 5/1999 | Volker et al. | 5/611 |
| 2003/0000015 | A1 | * | 1/2003 | Horlin | 5/600 |

FOREIGN PATENT DOCUMENTS

| | | | | | |
|---|---|---|---|---|---|
| DE | U29819124 | | | 1/1999 | |
| DE | U29904301 | | | 5/1999 | |
| DE | U29907552 | | | 10/1999 | |
| EP | 516089 | A1 | * | 12/1992 | 5/611 |
| FR | 2488506 | A | * | 2/1982 | 5/610 |
| GB | 1098954 | A | * | 1/1968 | 5/611 |
| SE | 169880 | | * | 1/1953 | 5/11 |

* cited by examiner

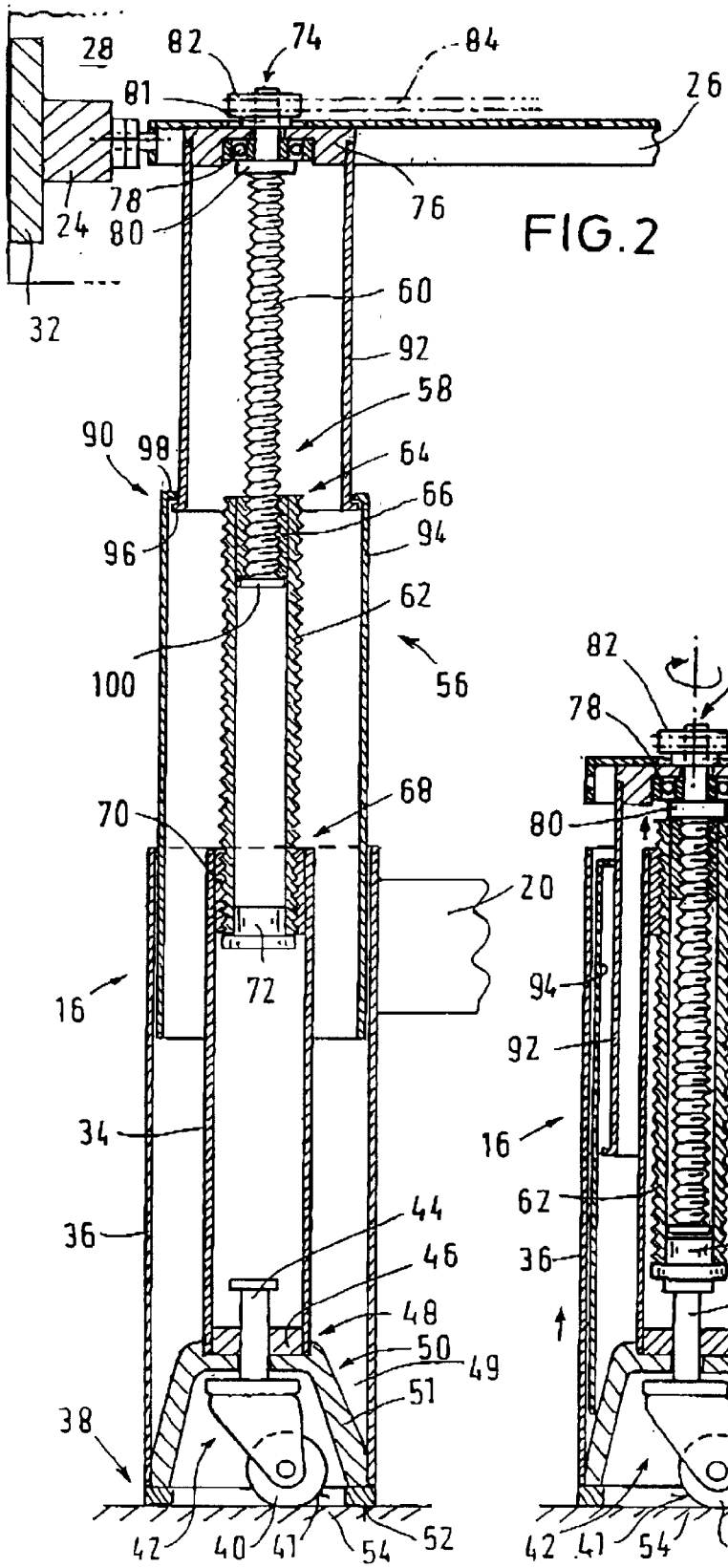
FIG. 2
FIG. 3
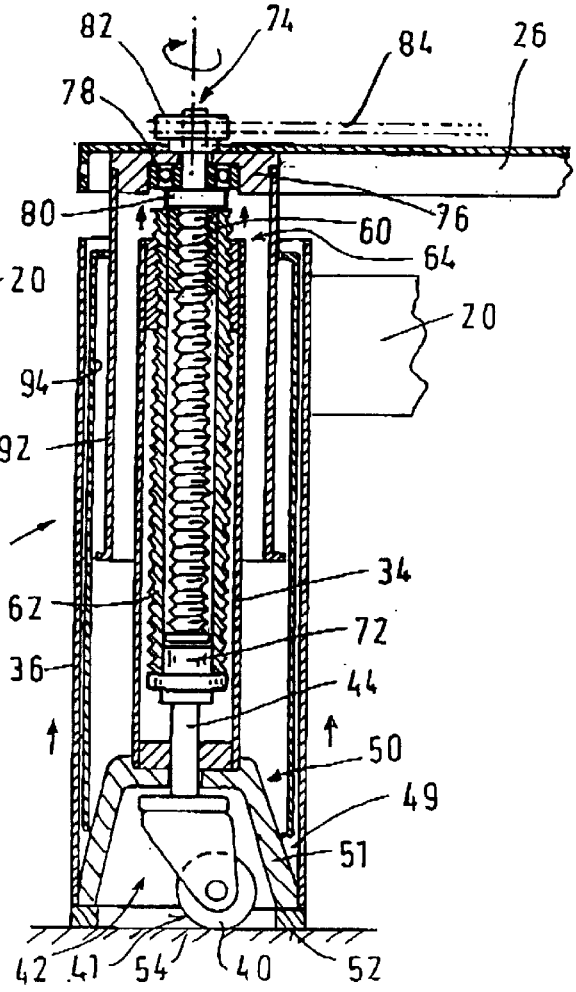

BED, ESPECIALLY A SICK-BED AND/OR NURSING BED, AND LENGTH-ADJUSTABLE SUPPORT ELEMENT FOR SAID BED

This application is the national phase under 35 U.S.C. §371 of PCT International Application No. PCT/EP00/02529 which has an International filing date of Mar. 22, 2000, which designated the United States of America.

The invention relates to a height-adjustable bed, in particular a sickbed or nursing bed, and further to a length-adjustable supporting element which can be used as a supporting leg for a bed.

Height-adjustable sickbeds and/or nursing beds are e. g. known from DE-C-39 40 666 and DE-A-44 05 509. Both known beds are provided with a lifting lower frame comprising four supporting legs Interconnected by connecting beams. Each supporting leg comprises at its lower end a swivelling and/or guide roller. In the completely retracted position of the lower frame said rollers are free such that the bed can be moved. If, however, the lower frame is extended, the lower ends of the supporting leges are placed on the floor in the case of the bed according to DE-C-39 40 666, whereas the swivelling rollers are braked in the case of the bed according to DE-A-44 05 509. Both known beds are not movable when the lower frame is moved out of its lowermost lifted position.

To enhance the comfort provided by a sickbed and/or nursing bed it is sometimes required that the bed can, on the one hand, be lowered to a relatively low position such that the patient can easily rise from the bed or sit down on the bed. On the other hand, it is required that the bed can be lifted as high as possible such that it is easily positionable into a working height convenient for the nursing personnel. The supporting legs of the known nursing beds cannot be retracted and extended to a sufficient degree to fully meet these requirements.

It is an object of the invention to provide a bed, in particular a sickbed and/or nursing bed, as well as a length-adjustable supporting element usable as a supporting leg for such a bed, which has a small overall height and can be extended and retracted to a relatively large degree.

For solving this object the invention proposes a length-adjustable supporting element to be used as a supporting leg for a height-adjustable bed, in particular a sickbed and/or nursing bed, provided with a supporting leg, a supporting leg comprising a supporting edge at its lower end, a swivelling and/or guide roller comprising a tread and being received by said supporting leg, wherein the roller designed for moving purposes is displaceable from the lower end of the supporting leg beyond Its supporting edge and into the lower end of the supporting leg, and a lifting means movable out of the upper end of the supporting leg and into the upper end of the supporting leg, said lifting means comprising a supporting member which is attachable to a first element of an object to be supported by the supporting leg.

For said supporting element it is, provided according to the invention that the lifting means comprises a double-spindle arrangement having an inner spindle and a hollow spindle receiving said inner spindle, that said double-spindle arrangement can be brought in engagement with a driving element to be driven by a driving device attachable to the supporting member or the first part of the object, that the inner spindle threadedly engages with the hollow spindle and the hollow spindle threadedly engages with the supporting leg, and that the double-spindle arrangement cooperates with the retainiing element of the roller such that in the maximum lifted position of both spindles relative to the supporting edge of the supporting leg, the tread of the roller is moved into the supporting leg or aligned with the supporting edge of the supporting leg, in a minimum lifted position of both spindles, the tread of the roller is in alignment with the supporting edge of the supporting leg, and in a minimum retracted position of both spindles, the tread of the roller protrudes from the supporting edge of the supporting leg, in which minimum retracted position said spindles are moved beyond the minimum lifted position further into the supporting leg than in their minimum lifted position.

In the supporting element according to the invention the lifting means is configured as a double-spindle arrangement comprising two spindles which can be axially telescoped and threadedly engage with each other. The inner spindle can be rotatably driven by a driving device. Thus the inner spindle rotatingly moves into the second spindle configured as a hollow spindle or out of said second spindle. The hollow spindle threadedly engages with the supporting leg. The double-spindle arrangement and the retaining element for the roller are disposed such that, in a maximum lifted position of the double-spindle arrangement relative to the supporting edge of the supporting leg, the tread of the roller is moved into the supporting leg or aligned with the supporting edge of the supporting leg. In a minimum lifted position of the double-spindle arrangement the tread of the roller is in alignment with the supporting edge of the supporting leg; in other words, the roller does not protrude downwards beyond the supporting edge of the supporting leg. If the double-spindle arrangement is moved into the supporting leg from the direction of the maximum lifted position via the minimum lifted position further up to a minimum retracted, position, the tread of the roller protrudes beyond the supporting edge of the supporting leg.

The mechanism according to the invention can, on the one hand, be realized by the retainer of the swivelling roller being fastened to the hollow spindle or the inner spindle thus moving, together with the spindle, through the supporting leg as a function of the respective lifted position of the double-spindle arrangement. An alternative to this concept is supporting the retainer to the lower end of the swivelling roller such that the retainer is movable in axial direction of the supporting leg without the retaining element being permanently connected with the double-spindle arrangement. If the two spindles are arranged in a telescopic tube having at least two tube sections, it is also possible that one or both tube sections contact the retaining element of the swivelling roller when the minimum retracted position is approached and ensure extension of the retaining element beyond the lower end of the supporting leg. When the two spindles move, by rotation about their axes, into the supporting leg, one of the two inner ends of the spindles contacts the retaining element of the roller. At the moment of contact of the spindles or at least one spindle with the retaining element the supporting leg is retracted, its upper end displaying a distance to the fastening element arranged at the upper end of the inner spindle. Upon further rotation of the spindles the supporting leg is moved towards the fastening element which results in the supporting edge of the supporting leg moving upwards such that the roller protrudes downwards beyond the supporting edge. Thus the object resting on the supporting element can be moved.

Thus the invention provides a supporting element which has a small overall height and can be extended up to a maximum lifted position, wherein the functions of automatically fixing the object supported by the supporting element to protect it against movements, and automatically releasing said object from said fixed state for the purpose of moving the object are further integrated.

In a preferred aspect of the invention it is provided that the double-spindle arrangement is covered when it is moved upwards out of the supporting leg. For this purpose the lifting device comprises at least one tube section telescoping with the supporting leg, the tube section being attached to the fastening element and coaxially enclosing the double-spindle arrangement. Said at least one tube section is guided along the supporting leg. Appropriately, two or more such tube sections, which can be telescoped, are employed, wherein the lowermost tube section facing the supporting leg is guided along the supporting leg and can be telescoped with the latter.

If it is intended that the supporting element according to the invention has a minimum axial length in its minimum lifted position, it is appropriate to provide at least two tube sections which can be telescoped with each other and with the supporting leg and cover the double-spindle arrangement. To allow the tube sections to move as deeply as possible into the supporting leg and the supporting element to display a minimum overall height, it is advantageous if the swivelling roller is arranged in a truncated insertion part which is inserted into the lower end of a tube forming the supporting leg. The peripheral area of said insertion part extends at an acute angle to the wall of the supporting leg tube such that the tube section/sections can be inserted in the minimum lifted position or the minimum retracted position of the double-spindle arrangement into the space, tapering towards the end of the supporting leg tube, between the insertion part and the supporting leg tube. The end of said insertion part arranged at the lower end of the supporting leg forms the supporting edge of the supporting element and is required to retain and support an inner tube arranged coaxially to the supporting leg tube, said inner tube threadedly engaging with the hollow spindle. The swivelling roller being permanently connected with the hollow spindle or the inner spindle, can now be displaced through an opening into the upper end of the insertion part averting the lower end of the supporting leg when the lifting position of the double-spindle arrangement changes. For reasons of stability it is however preferred that the retaining element of the swivelling roller is supported in the upper end of the truncated insertion part such that is can be axially displaced, so that the double-spindle arrangement cooperates in the aforementioned manner with the retaining element for the purpose of displacing said retaining element to move the swivelling roller out of the lower end of the supporting leg. In a preferred aspect of the invention a guide pulley is arranged at the upper end of the inner spindle, around which guide pulley an endless driving means in the form of a chain or a toothed or V-belt is guided. Such a belt drive is driven by the driving device and can, at the same time, drive one or a plurality of guide pulleys and thus inner spindles. For example, in the case of a bed the head-side and base-side pairs can each be driven, separately from supporting legs, by a respective belt drive alternatively, the double-spindle arrangements of all four supporting legs can be driven by a common belt drive. Appropriately, a belt drive configured as a toothed belt with gears meshing therewith and acting as the guide pulleys is used.

The extension and retracting movements of the two spindles out of the supporting leg and into the supporting leg are appropriately controlled or stopped by limit switches. In a preferred aspect the supporting element according to invention thus comprises a first limit switch, with one of two switching states of said limit switch signalling that the maximum lifting position has been reached. In the case of a double-section covering telescopic tube this maximum lifted position can be determined by inquiring the relative axial position of the two tube sections of the telescope. However, in the supporting element according to, the invention a three-section covering telescopic tube is used because of the requirement for as small an overall height as possible in the minimum lifted position, the supporting leg tube forming one of the three telescopic tube sections. Unfortunately, such a three-section telescopic tube does not allow to inquire that tube section which is, in this case, located nearest to the supporting leg tube about its position relative to the supporting leg tube to deduce the maximum lifted position. The reason for this is that the movement of the middle tube section during extension and retracting of the double-spindle arrangement is not defined.

In the preferred aspect of the invention to be described here a different principle is therefore applied for actuating the first limit switch. A first actuating element actuating the first limit switch is supported, such that it is movable between a first position and a second position, on the supporting member supporting the object to be supported. Said first actuating element is biased by a biasing force into the first position. Connected with the first actuating element is a pull element whose other end is fastened to an anchoring element which, in turn, is stationarily arranged relative to the supporting leg. Appropriately, said anchoring element is fastened to the supporting leg tube or, if present, to the inner tube arranged coaxially to the supporting leg tube and receiving the double-spindle arrangement. The anchoring element is located in the space between the inner tube and the supporting leg tube. When the double-spindle arrangement is extended und moved up to its maximum lifted position, the pull element exerts a pull force upon the actuating element when the maximum lifted position has been reached, which actuating element is thus moved from its first position, against the biasing force, into its second position. In this co nnection the switching state of the first limit switch is changed such that an electrical indication shows that the maximum lifted position has been reached.

The pull element may, e. g. be a traction rope, a chain or the like which is automatically wound up and thus shortened when the double-spindle arrangement is retracted into the supporting leg. For this purpose a take-up device is necessary. This requires relatively large efforts to be made. Therefore it would be better to configure the pull element as a telescopic rod with an inner rod and an outer rod axially guiding said inner rod, wherein one of the two rods is connected with the first actuating element and the other one is connected with the anchoring element. The telescopic rod is extended by pulling the inner rod out of the outer rod until it has reached its maximum length. Due to its permanent anchoring to the; anchoring element the pull rod acts upon the first actuating element when the maximum lifted position has been reached to move said actuating element relative to the supporting member and against the biasing force into the second position. Owing to the telescopic rod arrangement the pull element can be telescoped to a relatively short dimension, which is necessary to keep the overall supporting element as small as possible in the minimum lifted position. The outer rod of the telescopic rod is axially guided in the anchoring element and can thus be moved to the lower end of the supporting leg and telescoped into the latter. In the maximum lifted position the extending movement of the telescopic rod is limited by corbresponding stops of the rod and the anchoring element.

To allow the reaching of the minimum lifted position to be electrically indicated, too, the supporting element is provided, according to a preferred aspect of the invention, with a second limit switch and a second actuating element. This actuating element, too, is supported at the supporting member such that it is movable between a first and a second position. Said second actuating element, like the first actuating element, is biased by a biasing force into the first position. When the minimum lifted position has been reached, the supporting member supporting the second actuating element is positioned near the anchoring element stationarily arranged at the supporting leg. The second actuating element axially protruding from the supporting member towards the anchoring element contacts the anchoring element and is, upon further inward movement of the double-spindle arrangement, moved upwards out of the supporting member. This movement out of the supporting member can be detected by the second limit switch such that an electrical indication can show that the minimum lifted position has been reached.

Said second actuating element can further be used to actuate a third limit switch whose switching state indicates that the minimum retracted position, i. e. the extended position of the swivelling rollers, has been reached. When the double-spindle arrangement is moved further into the supporting leg after the minimum lifted position has been reached the second actuating element moves further upwards beyond the supporting member. Above the second limit switch the third limit switch is located which is tripped when the second actuating element protrudes by a certain extent beyond the supporting member, thus indicating the minimum retracted position of the double-spindle arrangement in the supporting leg. Thus this position would be electrically detectable, too. With the aid of all signals of the limit switches a forced cutoff of the driving motor can be controlled, which enhances the operating convenience of the supporting leg.

Alternatively to the employment of the second actuating element for the purpose of actuating the third limit switch it is, of course, also possible to movably arrange a third actuating element on the supporting member, said third actuating element tripping the third limit switch.

When the length-adjustable supporting element according to the invention is used for the supporting legs of a height-adjustable bed, it is sometimes desirable that these beds are moved into a Trendelenburg's or anti-Trendelenburg's position. This requires that the side parts (cheeks) connecting the head and base parts are supported, such that they can pivot about an axis extending transversely to the longitudinal extension of the supporting legs, at an lower frame of the bed encircling the supporting legs. By inquiring about the inclination by means of limit switches, automatic cutoff of the drive can be achieved when the Trendelenburg's or anti-Trendelenburg's position has been reached. Appropriately a pivoting element is supported, near the supporting member, about a pivoting axis extending transversely to the longitudinal extension of the supporting leg, wherein said pivoting element comprises another actuating element for actuating either the fourth or the fifth limit switch for the purpose of signalling that the maximum inclination of the bed (Trendelenburg's or anti-Trendenlenburg's position) has been reached. The two additional limit switches can be attached in a compact arrangement at a common holder.

The invention is described in detail above with reference to the supporting element. This description of the invention is equally applicable when a plurality of said supporting elements are used as height-adjustable supporting legs of a bed, in particular a sickbed and/or nursing bed.

Figure 6:
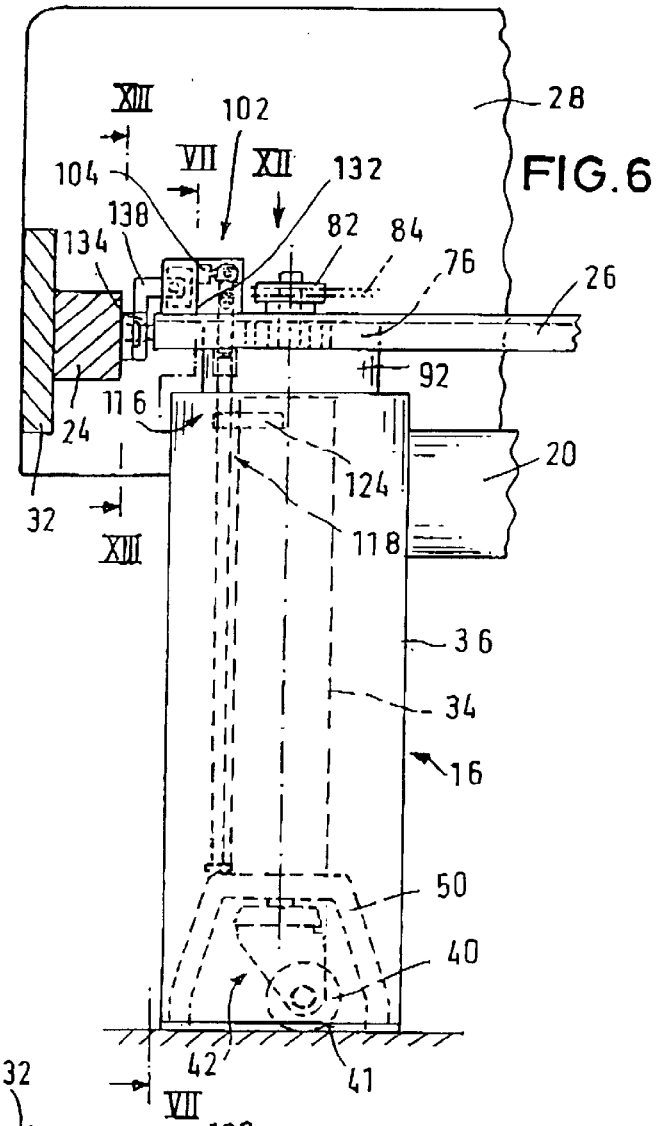
Figure 12:
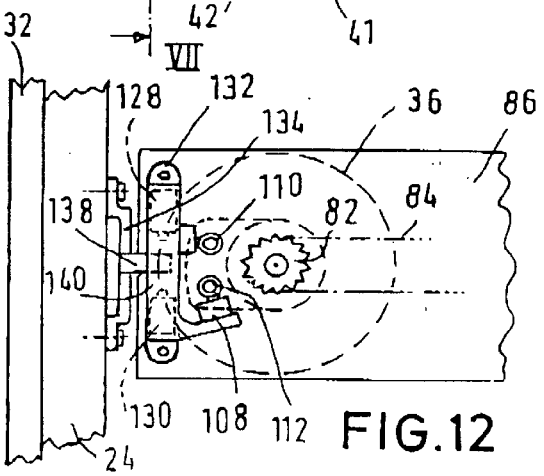
Figure 13:
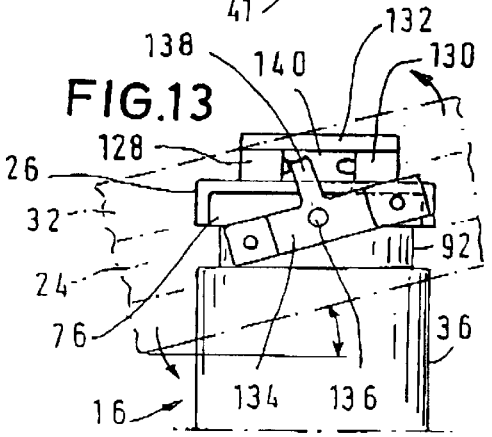
Figure 8:
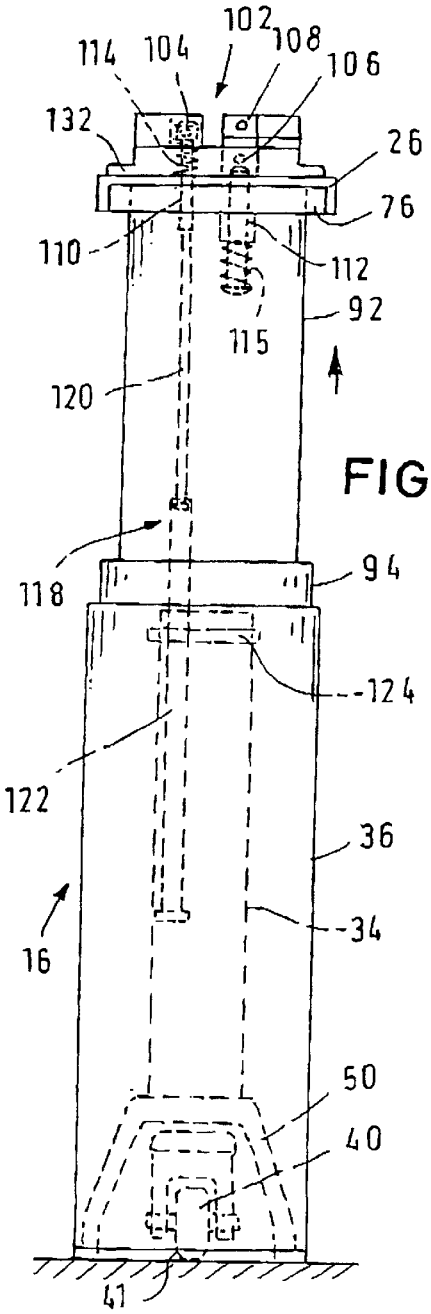
Figure 9:
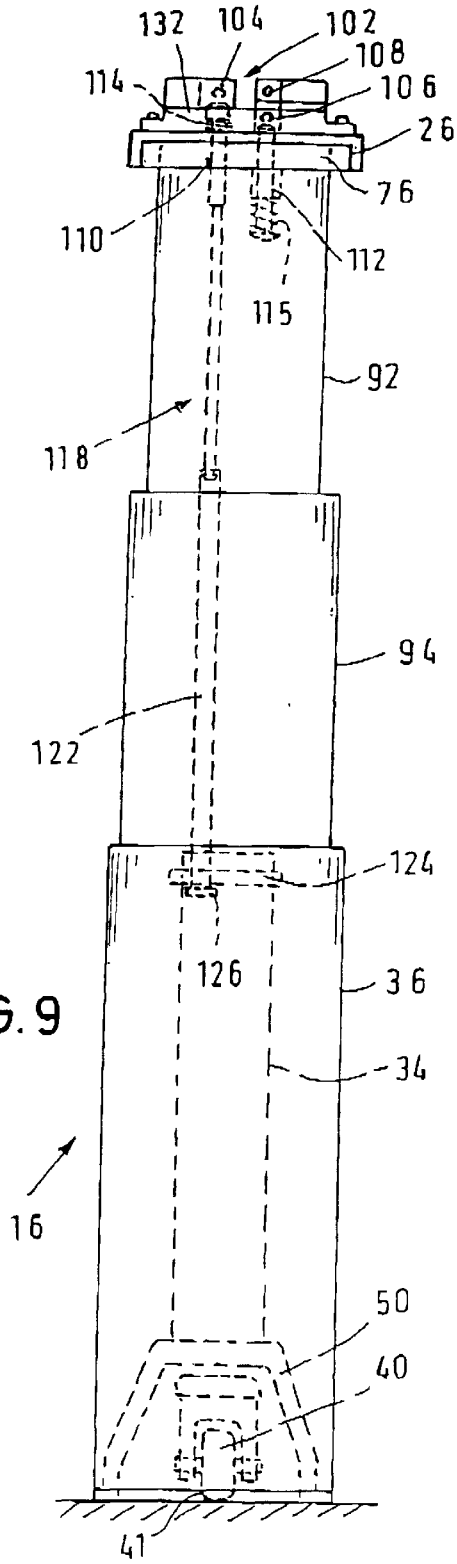

Hereunder an embodiment of the invention is explained in detail with reference to the drawings in which:

FIG. 1 shows a perspective representation of a bed with height-adjustable lower frame, FIGS. 2 to 5 show longitudinal sections of one of the supporting legs of the lower frame of the bed shoon in FIG. 1, the supporting leg being shown in different extended positions, FIGS. 6 to 11 show another type of representation of one of the supporting legs of the lower frame of the bed shown in FIG. 1 to illustrate the cooperation of the limit switches indicating the maximum and mini-minimum lifted positions and the minimum retracted position, with the actuating elements associated with said limit switches, FIG. 12 shows a top view of the upper side of the supporting leg of the bed shown in FIG. 1 in the direction indicated by arrow XII of FIG. 6, and FIG. 13 shows a sectional view taken along the line XIII—XIII of FIG. 6.

FIG. 1 shows a perspective representation of a sickbed and/or nursing bed 10 comprising an upper frame 12 and an lower frame 14 configured as a lifting frame. Said lower frame 14 comprises four supporting legs 16 which are of telescopic configuration. The four supporting legs 16 are interconnected by longitudinal beams and crossbeams 18,20.

The upper frame 12 of the bed 10 comprises a frame 22 having longitudinal bars 24, and crossbeams 26 extending transversely to said longitudinal bars 24. The longitudinal bars 24 protrude at their ends beyond the junction points with the crossbeams 26. To the protruding ends of the longitudinal bars the head and the base part 28,30 of the bed 10 are attached; to the longitudinal bars 24 side parts 32 of the bed can be attached. Said side parts 32 can also be fastened to the head and base parts 28,30 of the bed. It is also possible to do without the side parts 32 when the mattress support (not shown in FIG. 1), comprising a plurality of motor-adjustable support elements, is correspondingly configured at its longitudinal sides.

The setup of a supporting leg 16 is explained in detail below with reference to FIGS. 2 to 5. The length-adjustable supporting leg 16 comprises an inner tube 34 and an outer tube 36 arranged concentrically to said inner tube 34. To the outer tubes 36 of the supporting legs 16 the longitudinal beams and crossbeams 18,20 are attached. At ist lower end 38 each supporting leg 16 comprises a guide and/or swivelling roller 40 having a tread 41, wherein the roller 40 is retained by a retaining element 42 comprising a guide pin 44. Said guide pin 44 is guided in a lower front-side insertion plate 46 such that it is axially displaceable, said insertion plate 46 being arranged at the lower end 48 of the inner tube 24. The outer tube 36 protrudes beyond the lower end 48 of the inner tube 34; in this area a truncated or bell-shaped insertion part 50 is inserted into the supporting leg 16, said insertion part 50 being open towards the lower end 38 of the supporting leg 16 and receiving the roller 40 and the retaining element 42. The peripheral wall 51 of the insertion part 50 extends at an acute angle to the outer tube 36 such that between the two parts a tapering space 49 is formed in which a tube covering is inserted in the lowermost position of the supporting leg 16 in a space-saving and overall height-saving manner (see FIGS. 3 to 5).

The lower end 38 of the supporting leg 16 is formed by the lower end of the outer tube 36. Said lower end 38 is provided with an annular supporting edge 52 via which the supporting leg 16 rests on a floor 54 with the guide pin 44 being freely movable into the lower end 48 of the inner tube 34. This situatiuon is shown in FIGS. 2 and 3.

To allow the supporting leg 16 to be telescoped and thus adjusted in length, the supporting leg 16 is provided with a lifting means 56 comprising a double-spindle arrangement 58. Said double-spindle arrangement 58 comprises an inner spindle 60 and a hollow spindle 62 which threadedly engage with each other. For this purpose the hollow spindle 62 comprises at its one axial ends (upper end) 64 an insertion part 66 with a female thread which threadedly engages with the male thread of the inner spindle 60. By rotation of the inner spindle 60 the inner spindle 60 moves coaxially to the hollow spindle 62 into the hollow spindle or out of the hollow spindle.

The hollow spindle 62 can be rotated such that it moves into the inner tube 34 of the supporting leg 16 or out of the inner tube 34. For this purpose the inner tube 34 comprises at its upper end 68 an insertion part 70 with a female thread which thre dedly the male thread of the hollow spindle 62. The lower end of the hollow spindle 62 located in the inner tube 34 is closed by a pressing body 72 which is described in detail below.

At the upper end 74 of the inner spindle 60 the inner spindle 60 is rotatably supported on a supporting member 76. Said supporting member 76 is fastened from below to the frame 22 of the bed 10, wherein the crossbeam 26 rests on the supporting member 76. The supporting member 76 comprises the pivot bearing 78 through which extends the upper end 74 of the inner spindle 60. As seen in the axial direction of the inner spindle 60 stop rings 80 are located on both sides of the pivot bearing 78 and/or the supporting member 76, said stop rings 80 preventing a translatory relative movement of the inner spindle 60 relative to the supporting member 76 when the inner spindle 60 is rotated.

As further shown in FIGS. 2 to 5 and in FIG. 1 gears 82 are attached to the upper ends 74 of the inner spindles 60 of each supporting leg 16. About the gears 82 of each of the head part-side and base part-side pairs of supporting legs a belt drive comprising a toothed belt 84 extends along the crossbeams 26 of the bed frame 22. A driving gear 86 (see FIG. 1) meshes with each toothed belt 84, said driving gear 86 being driven by a driving motor 88. In this way the head part-side and base part-side double-spindle arrangements 58 can be synchronously actuated in pairs and separately for the head part-side and base part-side supporting legs 16 by the drives 88.

As further shown in FIGS. 2 to 5, a telescopic tube arrangement 90 is attached to the the supporting member 76 associated with a supporting leg 16. Said telescopic tube arrangement 90 extends coaxially to the double-spindle arrangement 58 and is guided in the outer tube 36 of the supporting leg 16. The tube arrangement 90 comprises an upper tube section 92 telescoping with a middle tube section 94 which, in turn, is guided in the outer tube 36 of the supporting leg 16 and telescopes with the latter. While the middle tube section 94 freely movable between the outer tube 36 and the upper tube section 92 automatically moves into the outer tube 36, it is taken along by an outer collar 96 on the upper tube section 92 during the upward movement, said outer collar 96 being embraced by an inner collar 98 on the middle tube section 94.

The functioning of the supporting leg 16 during extending and retracting of the double-spindle arrangement 58, i. e. for length adjustment of the supporting leg 16, is briefly explained below with reference to FIGS. 2 to 5. In FIG. 2 the supporting leg 16 is shown to be in its fully exended position (maximum lifted position). The roller 40 is completely drawn into the lower end of the supporting leg 16 such that the supporting leg 16 rests on its supporting edge 52. By rotating the inner spindle 60 via the drive configured as belt drive 84, the inner spindle 60 is moved into the hollow spindle 62. When the spindle 60 has been completely moved into the hollow spindle 62, the hollow spindle 62 is taken along. The reason for this is that the stop element 80 bears upon the upper end 64 of the hollow spindle 62 when the inner spindle 60 is retracted and prevents further rotational movement of the inner spindle 60 relative to the hollow spindle 62.

Upon further rotation of the inner spindle 60 the hollow spindle 62 is moved into the inner tube 34 until the pressing body 72 bears upon the guide pin 44 (minimum lifted position). This situation is shown in FIG. 3.

Upon further rotation of the two spindles 60,62 into the supporting leg 16 the inner and outer tubes 34,36 move upwards. The distance of the upper end 68 of the inner tube 34 and the distance of the upper end of the outer tube 36 to the supporting member 76 is sufficiently large such that in the case of fully inserted double-spindle arrangement 58 such an upward movement of the inner and outer tubes 34,36 is possible. Consequently, the supporting edge 52 is removed from the floor 54 so that the supporting leg 16 solely rests on the roller 40 (see FIG. 4). In this state the bed 10, which has been lowered down to the lowermost position, can be moved (minimum retracted position or extended position of swivelling rollers).

Figure 4:
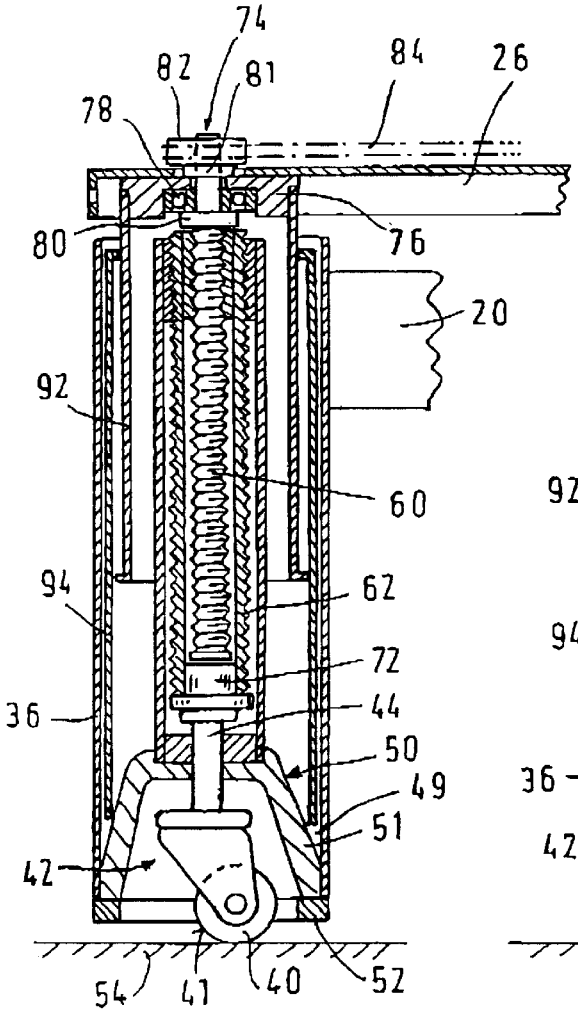
Figure 5:
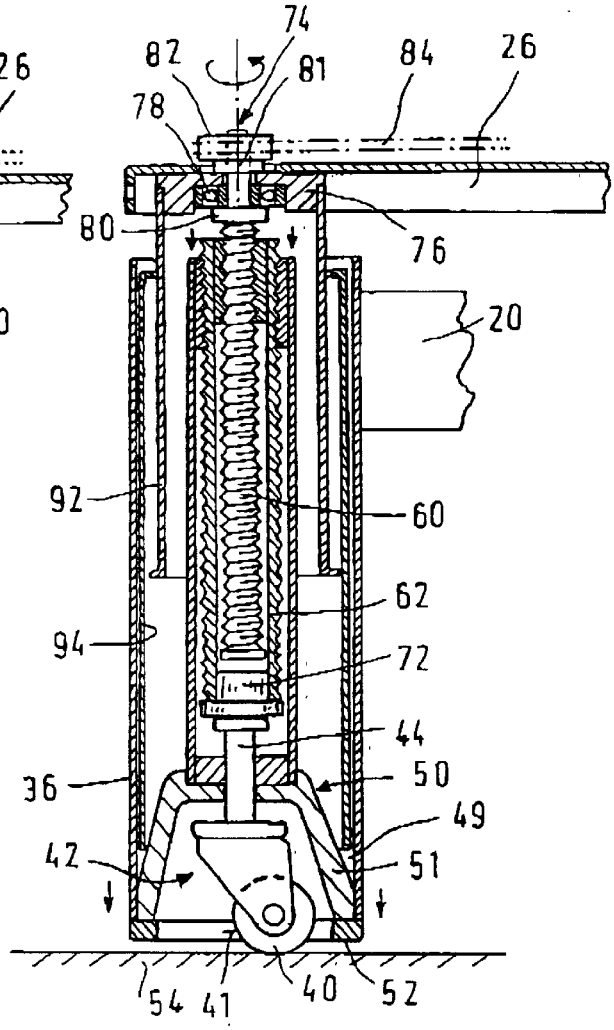

If, proceeding from the situation shown in FIG. 4, the double-spindle arrangement 58 is driven in the reverse direction, the spindles 60,62 move out of the supporting leg 16. In the initial phase the inner and outer tubes 34,36 are first lowered (see FIG. 5) until the supporting edge 52 rests on the floor 54 (minimum lifted position). Only then the double-spindle arrangement 58 moves further out of the inner tube 34. In the initial phase of this movement one of the two spindles moves relative to the other and/or relative to the inner tube 34. The movement of the hollow spindle 62 out of the inner tube 34 ends at that moment at which the pressing body 72 bears upon the threaded insertion part 70 at the upper end 68 of the inner tube 34. Upon further rotation the inner spindle 60 moves out of the hollow spindle 62 by a screwing movement until this extension movement ends in the maximum lifted position shown in FIG. 2. If, during the extension movement of the double-spindle arrangement 58 the inner spindle 60 first moves in the hollow spindle 62, the hollow spindle 62 is rotationally taken along by the inner spindle 60 at that moment at which a radially protruding flange 100 arranged at the inner end of the inner spindle 60 strikes the female-threaded insertion part 66.

The embodiment described here relates to the case in which the pressing. body 72 attached to the hollow spindle 62 acts upon the guide pin 74. Alternatively it is conceivable that the hollow spindle 62 is open at its lower end and that the inner spindle 60 then acts upon the guide pin 44.

In the different positions described above with reference to FIGS. 2 to 5, i.e the maximum and minimum lifted positions and the minimum retracted position or the extended position of the swivelling rollers, the driving motor 88 is automatically cut off by means of a limit switch device 102. Said limit switch device 102 comprises a first limit switch 104, a second limit switch 106 and a third limit switch 108 (see FIGS. 6 to 11). To these three limit switches 104,106,108, which are configured as key buttons, a frist and a second actuating element 110,112 are associated, wherein the first actuating element 110 actuates the first limit switch 104 and the second actuating element 112 acts upon the other two limit switches 106 and 108. The two actuating elements 110,112 are configured as pins which are supported, as seen in the axial extension of the supporting leg 16, on the supporting member 76 such that they are axially displaceable, and extend beyond the upper side of the supporting member 76 and through the crossbeam 26. The first actuating element 110 is biased into a first position in which it protrudes beyond the upper side of the crossbeam 26 to a larger extent than in its second position into which it can be moved by the tension applied by a helical compression spring 114 applying a biasing force, which helical compression spring 114 is supported between a thickened end of the first actuating element 110 and the supporting member 76. The second actuating element 112 is also biased in its first position, namely by the helical spring 151 towards the lower side of the supporting member 76 beyond which it protrudes towards the outer tube 36. In this first position the second actuating element 112 does not protrude beyond the upper side of the crossbeam 26 such that it does not actuate the second limit switch 106.

With the first actuating element 110 a pull element 116 in the form of telescopic pull rod 118 is connected which extends coaxially to the extension of the supporting leg 16 into the outer tube 36 of the supporting leg 16 and is arranged between the inner tube 34 and the outer tube 36. Said telescopic rod 118 comprises an inner rod 120 and an outer rod 122 (see e.g. FIGS. 8 and 9). The movement for extending the inner rod 120 out of the outer rod 122 is limited as is the movement for taking along the telescopic rod 118 during extension of the supporting leg 16, namely by the outer rod 122 being guided through a passage opening in an anchoring and stop element 124 which is permanently attached to the outside of the inner tube 34. The cooperation of the anchoring and stop elements 124 with the telescopic rod 118 for moving the first actuating element 110, and with the second actuating element 112 is described below with reference to FIGS. 7 to 11.

Figure 7:
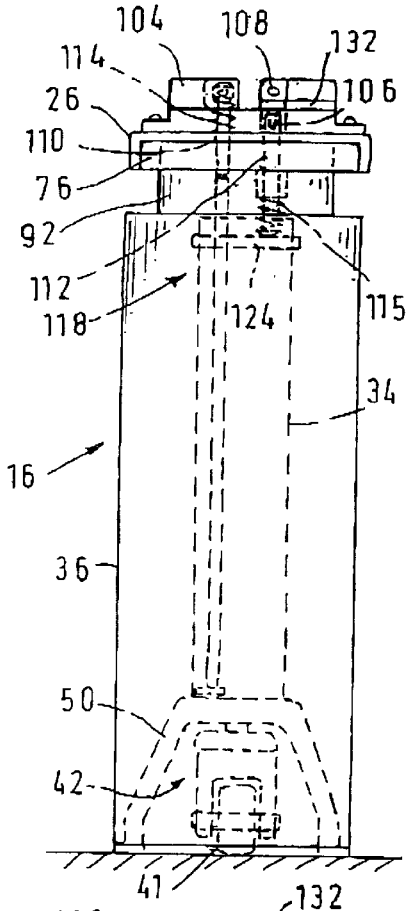

FIG. 7 which shows the supporting leg position corresponding to that of FIG. 3, shows the situation in the minimum lifted position. In this position the second limit switch 106 is set to its closed state b the second actuating element 112, which is shows that the minimum lifted position has been assumed. In this embodiment the first limit switch 104, too, is set to its closed state by the first actuating element 110 in the minimum lifted position. This switching state is however not inquired about. If, proceeding from the situation shown in FIG. 7, the supporting leg 16 is extended, the second actuating element which, in the minimum lifted position, has been moved against the biasing force into the second position by the anchoring and stop element 124 for actuating the second switch 106, is released (see FIG. 8) such that the second limit switch 106 changes its switching state. Upon further movement for extending the supporting leg 16 the supporting member 76 or the first actuating element 110 supported on the supporting member 76 takes along the telescopic rod 118 such that first the inner rod 120 moves out of the outer rod 122 and then the outer rod 122 is moved through the opening in the achoring and stop element 124. This movement for taking along the telescopic rod 118 is continued until the widened lower end 126 of the outer rod 122 strikes from below against the anchoring and stop element 124. Upon further movement for extending the supporting leg 16 the supporting member 76 moves relative to the first actuating element 110 such that the latter is moved, against the force applied by the biasing spring 114, into its first position relative to the supporting member 76, thus releasing the first limit switch 104. Consequently, said limit switch 104 changes its switching state, which signalizes that the maximum lifted position has been reached (see FIG. 9 which corresponds to the supporting position shown in FIG. 2).

Figure 10:
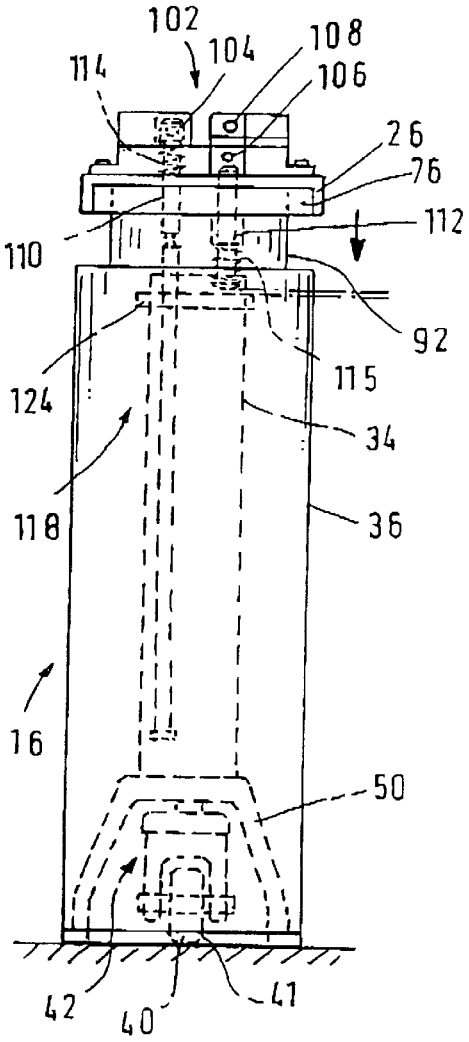

If the supporting leg 16, proceeding from a lifted position between the maximum lifted postion and the minimum lifted position, is moved into the minimum lifted position, the situation shown in FIG. 10 is attained shortly before the minimum lifted position is reached, said situation being comparable with the supporting leg position shown in FIG. 3. In this situation the anchoring and stop element 124 bears upon the second actuating element 112 or is arranged in the immediate vicinity of said actuating element 112. Upon further retraction movement of the supporting leg 16 the anchoring and stop element 124 shifts the second actuating element 112 upwards such that the second limit switch 106 is actuated (see FIG. 7). This signalizes that the minimum lifted position has been reached.

Figure 11:
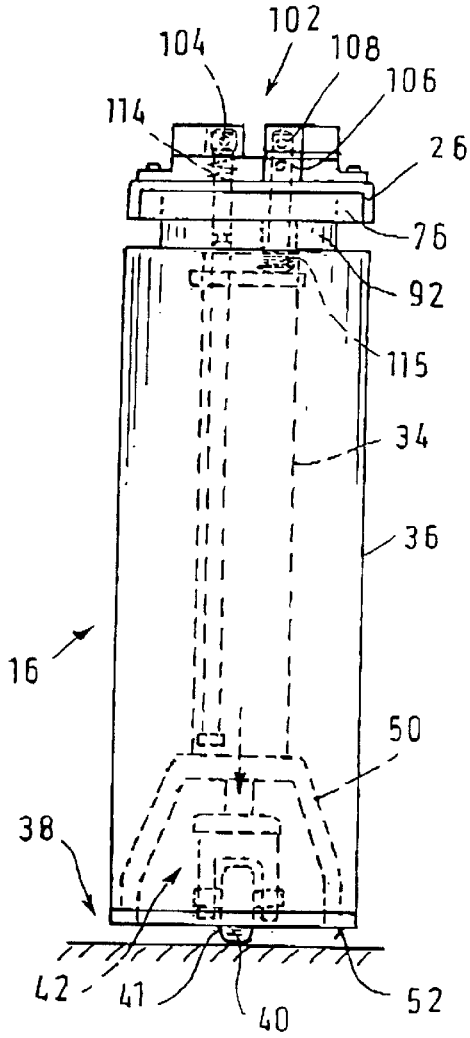

If the supporting member 76 is further moved towards the outer tube 36 of the supporting leg 16, the anchoring and stop element 124 shifts the second actuating element 112 further upwards and out of the supporting member 76 and the crossbeam 26 until the third actuating switch 108 arranged above the second limit switch 106 is actuated (see FIG. 11 which corresponds to the supporting leg position shown in FIG. 4). In this situation corresponding to that shown in FIG. 4, the lower end 38 of the supporting leg 16 is moved upwards beyond the swivelling roller 40 such that the bed now rests on the swivelling roller 40 and can be moved.

The arrangement described above provides a compact limit switch control for driving the double-spindle arrangement 58. All actuating elements and the parts acting upon said actuating elements as well as the limit switches form, as a compact unit, part of the supporting leg 16.

A special feature of the embodiment of the invention described here is dealt with below with reference to FIGS. 6, 12 and 13.

As is sometimes the case with nursing beds and sickbeds, the bed 10 of the present embodiment offers the possibility to incline the upper frame 12 into a Trendelenburg's and an anti-Trendelenburg's position. These two positions, too, are electrically detected, for which purpose a fourth and a fifth limit switch 128,130 are provided. These two limit switches 128,130 are attached, together with the other three limit switches 104,106,108, to a common holding part 132 which is fastened to the upper side of the crossbeam 26. The two limit switches.128,130 are arranged opposite to each other (see in particular FIGS. 12 and 13). Below the two limit switches 128,130 a pivoting element 134 is supported on the crossbeam 26 such that it is pivotable about a pivoting axis 136, wherein said pivoting axis 136 extends transverse to the longitudinal extension of the supporting leg 16. To the pivoting element 134 the longitudinal bar 24 of the upper frame 12 of the bed 10 is attached. From the pivoting element 134 another actuating element 138 extends into the space 140 between the two limit switches 128,130. As shown in FIG. 13, one of the two limit switches 128,130 is switched by the actuating element 138 when two relative pivoting positions of the longitudinal bars 24 relative to the supporting legs 16 have been reached, such that the driving motor 88 for the respective pair of supporting legs 16 can be automatically cut off.

As can be seen from the above, integration of the limit switches, which signalize that the Trendelenburg's and the anti-Trendelenburg's positions have been reached, is realized by a rather compact configuration in the embodiment described here.

What is claimed is:

1. Length-adjustable supporting element for a bed, in particular a sickbed and/or nursing bed, comprising a supporting leg comprising a supporting edge at its lower end, a swivelling and/or guide roller comprising a tread and being received by said supporting leg, wherein the roller designed for moving purposes is displaceable from the lower end of the supporting leg beyond its supporting edge and into the lower end of the supporting leg, and a lifting means movable out of the upper end of the supporting leg and into the upper end of the supporting leg, said lifting means comprising a supporting member which is attachable to a first element of an object to be supported by the supporting leg, characterized in that the lifting means comprises a double-spindle arrangement having an inner spindle and a hollow spindle receiving said inner spindle, said double-spindle arrangement can be brought in engagement with a driving element to be driven by a driving device attachable to the supporting member or the first part of the object, the inner spindle threadedly engages with the hollow spindle and the hollow spindle threadedly engages with the supporting leg, and the double-spindle arrangement cooperates with the retaining element of the roller such in the maximum lifted position of both spindles relative to the supporting edge of the supporting leg, the tread of the roller is moved into the supporting leg or aligned with the supporting edge of the supporting leg, in a minimum lifted position of both spindles, the tread of the roller is in alignment with the supporting edge of the supporting leg, and in a minimum retracted position of both spindles, the tread of the roller protrudes from the supporting edge of the supporting leg, in which minimum retracted position said spindles are moved beyond the minimum lifted position further into the supporting leg than in their minimum lifted position.

2. Supporting element according to claim 1, characterized by a limit switch device comprising a first limit switch for signalizing the maximum lifted position, and a first actuating element for said first limit switch, wherein the first actuating element is supported on the supporting member such that it is movable between a first position into which it is biased by a biasing force, and a second position, and connected via a pull element with an anchoring element arranged stationarily relative to the supporting leg, and wherein said first actuating element is movable against the biasing force from the first position into its second position by the pull element when the maximum lifted position has been reached.

3. Supporting element according to claim 2, characterized in that the limit switch device comprises a second limit switch to which a second actuating element is associated, the second actuating element is supported on the supporting member such that it is movable between a first position into which it is biased by a biasing force, and a second position, and the second actuating element is movable by the anchoring element against the biasing force from the first position into the second position when the minimum lifted position has been reached.

4. Supporting element according to claim 3, characterized in that the limit switch device a third limit switch, the second actuating element is supported on the supporting member such that it is movable from its first position into its second position and beyond said second position into a third position, and actuates said third limit switch in its third position, and the second actuating element is movable by the anchoring element into the third position when the minimum retracted position has been reached.

5. Supporting element according to claim 3, characterized in that the limit switch device comprises a third limit switch with which a third actuating element is associated, said third actuating element is supported on the supporting member such that it is movable between a first position into which it is biased by a biasing force, and a second position, and said third actuating element is movable by the anchoring element against the biasing force from the first position into the second position when the minimum lifted position has been reached.

6. Supporting element according to claim 2, characterized in that the pull element is a telescopic rod which is axially guided at the anchoring element and, when a maximum extended position has been reached at the anchoring element, retained to limit movement relative to said anchoring element.

7. Supporting element according to claim 2, characterized in that the limit switch device comprises a fourth and a fifth limit switch with which another actuating element is associated, the further actuating element is arranged on a pivoting element pivotable about a pivoting axis extending transverse to the axial extension of the supporting legs, and attachable to a second element of the object to be supported, wherein the first and the second element of the object to be supported are pivotable relative to each other, and the further actuating-element cooperates in a first pivoting position of the pivoting element cooperates in a first pivoting position of the pivoting element with the fourth limit switch, and in a second pivoting position of the pivoting element with the fifth limit switch.

8. Supporting element according to claim 1, characterized in that the movement of the inner spindle out of the hollow spindle and into said hollow spindle is limited by a respective stop, and that said hollow spindle is rotatable together with the inner spindle in both directions of rotation when the inner spindle bears upon said stops.

9. Supporting element according to claim 1, characterized in that the double-spindle arrangement comprises an upper tube section attached to the supporting member, and a middle tube section guided along said upper tube section, which middles tube section is also axially guided along the supporting leg, wherein the tube sections are arranged coaxially to the spindles.

10. Supporting element according to claim 9, characterized in that into the lower end of the supporting leg an insertion part configured as a truncated cone is inserted which comprises a peripheral wall extending from said lower end of the supporting leg at an acute angle to the axial extension of the latter, and that, in the minimal lifted position and the minimal retracted position of the spindle, the middle tube section is inserted into the space, tapering towards the end of the supporting leg, between the peripheral wall of said insertion part and the supporting leg.

11. Supporting element according to claim 10, characterized in that on the end of the insertion part averting the lower end of the supporting leg and located in the supporting leg an inner tube is supported which extends coaxially to the supporting leg and is designed for threadedly engaging with the hollow spindle and receiving said hollow spindle.

12. Supporting element according to claim 11, characterized in that the roller is retained by a retaining element which is guided axially to the supporting leg along the insertion part, and that the hollow spindle and/or the inner spindle and/or the upper and/or the middle tube section presses against the retaining element during movement of both spindles out of the minimum lifted position and into their minimum retracted position for the purpose of relative movement of the roller and the supporting leg for extending the tread of the roller from the lower end of the supporting leg.

13. Supporting element to claim 1, characterized in that at the upper end of the inner spindle a guide pulley is arranged, and that the driving element is an endless driving element guided around said guide pulley.

14. Supporting element according to claim 4, characterized in that the endless driving element is a driving chain, and that the guide pulley is a gear meshing with said driving chain.

15. A bed, in particular sickbed and/or nursing bed, comprising a height-adjustable lower frame comprising four supporting legs interconnected by connecting beams, an upper frame connected with the lower frame, said upper frame comprising two side parts and head and base parts connected with said side part, and two connecting elements for connecting two head part-side supporting legs and two base part-side supporting legs of the lower frame with said side parts of the upper frame, characterized in that each supporting leg is configured as a length-adjustable supporting element according to claim 1, wherein supporting members of the supporting elements are attached to said connecting elements.

16. A bed according to claim 15, characterized in that two pivoting elements, are pivotably supported at both ends of a connecting element and the side parts are attached to said pivoting elements.

17. A bed according to claim 15, characterized in that a respective driving device for the two head part-side and for the two base part-side supporting legs is attached to the connecting element connecting the respective supporting legs.

* * * * *